US007192485B2

(12) United States Patent
Richard et al.

(10) Patent No.: US 7,192,485 B2
(45) Date of Patent: Mar. 20, 2007

(54) APPLICATION DEVICE

(75) Inventors: Bernert Richard, Giengen (DE); Méndez-Gallon Benjamin, Königsbronn (DE); Ueberschär Manfred, Dettingen (DE)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 10/865,201

(22) Filed: Jun. 10, 2004

(65) Prior Publication Data

US 2004/0237885 A1 Dec. 2, 2004

Related U.S. Application Data

(63) Continuation of application No. 10/221,518, filed as application No. PCT/EP01/02826 on Mar. 13, 2001.

(30) Foreign Application Priority Data

Mar. 14, 2000 (DE) ..... 100 12 257

(51) Int. Cl.
*B05C 5/02* (2006.01)

(52) U.S. Cl. ..... 118/413; 118/414; 118/419; 118/DIG. 4

(58) Field of Classification Search ..... 118/413, 118/414, 419, 262, 249, DIG. 4, 50.1, 620; 427/299, 428, 420, 428.01
See application file for complete search history.

(56) References Cited

U.S. PATENT DOCUMENTS

| | | | | |
|---|---|---|---|---|
| 3,107,387 A | | 10/1963 | Katt | 15/375 |
| 3,369,522 A | | 2/1968 | Alix | 118/50 |
| 5,976,630 A | | 11/1999 | Korokeyi et al. | 427/420 |
| 6,142,409 A | * | 11/2000 | Stewart et al. | 242/615.2 |
| 6,146,690 A | | 11/2000 | Kustermann | 427/8 |
| 6,248,174 B1 | | 6/2001 | Kustermann | 118/665 |

FOREIGN PATENT DOCUMENTS

| | | |
|---|---|---|
| DE | 19817202 | 10/1999 |
| DE | 19903559 | 10/1999 |
| DE | 19950276 | 4/2000 |
| EP | 0872592 | 1/1998 |
| WO | WO 97/03009 | 1/1997 |

* cited by examiner

*Primary Examiner*—Laura Edwards
(74) *Attorney, Agent, or Firm*—Taylor & Aust, P.C.

(57) ABSTRACT

A device (510) for the direct or indirect application of liquid or pasty application medium (516) by means of an applicator unit (512) to a material web (520), in particular of paper or board, comprises a device (570) upstream of the applicator unit (512) in the running direction (L) of the substrate (U) in order to attenuate the air boundary layer (G) carried along by the substrate (U). The attenuation device can in this case comprise a sealing element (570) which is pressed in a sealing manner against the substrate (U) and rolls on the latter substantially without slippage, and/or can comprise an electrode arrangement and/or can comprise an ultrasound source and/or can comprise a resilient diaphragm element acting without contact.

23 Claims, 7 Drawing Sheets

APPLICATION DEVICE

This is a continuation of application Ser. No. 10/221,518 filed Jan. 21, 2003, now abandoned, which is a 371 of PCT/EP01/02826 filed Mar. 13, 2001.

DESCRIPTION

The invention relates to a device for the application of liquid or pasty application medium by means of an applicator unit to a moving substrate, the substrate, in the case of direct application, being the surface of a material web, in particular or paper or board, and, in the case of indirect application, being the surface of a transfer element, preferably a transfer roll, which then transfers the application medium to the surface of the material web, and a device for attenuating the air boundary layer carried along by the substrate being arranged upstream of the applicator unit in the running direction of the substrate.

Although the air boundary layer carried along by the substrate can have a detrimental effect on the application result in other types of applicator units as well, the invention will be discussed in more detail below using the example of a curtain application device, that is to say an application device in which the applicator unit discharges the application medium onto the substrate as a curtain or veil which moves substantially under the force of gravity.

In the coating of material of webs by using a curtain applicator unit (also known as "curtain coating" in the specialist world), the application medium is discharged to the substrate in the form of an application medium curtain, which moves from the applicator unit to the substrate substantially under the force of gravity. The fact that in this case the curtain applicator unit is located at a predetermined distance from the substrate has, inter alia, the advantage that it is exposed to a lower risk of damage, for example in the event of a web break. Curtain applicator units differ fundamentally from other "non-contact" applicator units, for example free-jet nozzle applicator units, in which the movement of the application medium from the applicator unit to the substrate is brought about primarily by the expulsion momentum from the discharge nozzle of the applicator unit, since the shape of the curtain emerging from the discharge nozzle is exposed only to the interplay between the surface tension of the application medium and the force of gravity. In this case, the surface tension attempts to contract the curtain which, in relation to its volume or its cross-sectional area, has a very large surface or circumferential length, in order in this way to reduce its surface. This effect is opposed only by the force of gravity, which attempts to stretch the curtain. It can therefore easily be seen that it is all the more difficult to obtain an application medium curtain which is uniformly thick over the entire working width, the greater this working width is.

The coating of material webs by means of a curtain applicator unit, which supplies the material web with the application medium as an application medium curtain or veil that moves substantially under the force of gravity, has been known for a long time from the coating of photographic films, audio tapes and the like. However, the material webs in these areas of application have a considerably lower width than is the case in modern installations for the production of paper and paperboard webs, in which material web widths of more than 10 m are required. To be able to form an application medium curtain which is uniformly thick over this width and to keep it stable is a task in which it is everything but obvious to expect suggestions for a working solution from the comparatively simply controlled, known narrow application medium curtains. Furthermore, in modern installations for the production of paper and paperboard webs, the material webs move at speeds of up to 3000 m/min, which is many times the speed at which the known narrow material webs move and, furthermore, constitutes a further high loading on the stability of the application medium curtain.

DE 199 03 559 A1 presents a whole series of principles of action which are intended to permit the air boundary layer carried along by the material web to be attenuated immediately upstream of a curtain applicator unit. However, this document does not discuss the possible ways of improving the efficiency of these principles of action.

WO 97/03009 tackles the problem of the drying of material webs following the application of media, specifically printing inks, in particular in gravure, web-fed offset and flexographic printing. It proposes to ionize the gas molecules on the surface of the material web by means of a corona discharge and to accelerate them toward an electrode, in order to increase the drying efficiency by the gas exchange at the material web surface which is associated with this "ion wind".

For completeness, reference should further be made to DE 198 03 240 A1 and DE 198 29 449 A1 in relation to the further prior art.

By contrast, it is an object of the present invention to further improve the application devices for use in installations for the production and/or finishing of wide and fast-moving material webs, preferably of paper or board, in particular as far as attenuating the influence of the air boundary layer is concerned.

According to the invention, this object is achieved by a device for the application of liquid or pasty application medium by means of an applicator unit to a moving substrate, the substrate, in the case of direct application, being the surface of a material web, in particular of paper or board, and, in the case of indirect application, being the surface of a transfer element, preferably a transfer roll, which then transfers the application medium to the surface of the material web, a device for attenuating the air boundary layer carried along by the substrate being arranged upstream of the applicator unit in the running direction of the substrate, and the attenuation device comprising a sealing element which is pressed in a sealing manner against the substrate and rolls on the latter substantially without slippage. Because of being pressed against the substrate, this sealing element constitutes an effective barrier to the air boundary layer and, in addition, because of the rolling on the substrate, ensures that the surface of the substrate is not loaded excessively greatly.

The sealing element can be, for example, a sealing roll and/or an endlessly circulating sealing belt.

In order to be able to prevent the renewed formation of an air boundary layer on the running section of the substrate between the attenuation device and the position at which the application medium strikes the substrate, it is advantageous if this running section can be as short as possible. In order to be able to achieve this, a development of the invention proposes that the sealing roll has a diameter of between about 10 mm and about 38 mm. Such sealing elements of the doctor bar type can be arranged particularly closely upstream of the position at which the application medium strikes the substrate, because of their relatively strikes the substrate, because of their sealing rolls of larger diameter can also be used, as will be explained in more detail further below.

In order to be able to reduce the stress on the surface of the substrate further, it is proposed that the sealing element has a rubber-covered surface. However, it is also possible for the sealing element to have a metallic surface, or example a chromium-plated surface. In order to increase the efficiency of the attenuation of the air boundary layer, it may also be possible for the sealing element to be temperature-controlled, that is to say heated and/or cooled, and/or electrostatically charged.

In order to be able to increase the barrier action to the air boundary layer further, provision can be made for the sealing element to be constructed as a suction element. However, the sealing element can also be constructed as a pump element, which expels gas, preferably air, water vapor or the like, in order to "blow away" the air boundary layer from the substrate.

Both in the case of the construction as a suction element and in the case of the construction as a pump element, the cover of the sealing element can be provided with a plurality of apertures and/or be formed of porous material.

In a development of the invention, it is proposed that a suction opening of a suction device be arranged between the sealing element and the applicator unit in the running direction of the substrate. By means of this suction device, that part of the air boundary layer which could not be removed from the substrate by the sealing element can be attenuated further. In this case, apart from its section which engages with the substrate, the sealing element can be accommodated substantially completely in a suction box of the suction device. This applies in particular to sealing rolls with a relatively large diameter.

In order to improve the suction efficiency, provision can further be made for the suction opening to be bounded on the outlet side and/or the feed side by a diaphragm element, for example a resiliently deformable diaphragm element, which is preferably set against the surface of the substrate as a trailing scraper. This trailing scraper prevents the air boundary layer moving onward toward the applicator unit and therefore leads to the air carried along in the air boundary layer backing up. This destroys the laminar character of the flow of the air boundary layer and leads to its at least partial conversion into a turbulent flow, which facilitates extraction.

The trailing scraper can be constructed as a flexible foil, preferably made of plastic, metal sheet or a composite material. The flexible foil nestles against the substrate under the suction action of the sucking device, which firstly improves the sealing and secondly prevents the formation of a new air boundary layer. If the trailing scraper is fabricated from metal sheet, then use is preferably made of stainless steel sheet with a thickness of at most 0.2 mm. However, trailing scrapers made of composite material with a surface coating of Teflon have also proven to be advantageous. In this case, the composite material ensures the necessary temperature resistance and flexibility, while the Teflon surface coating ensures low friction between the trailing scraper and the moving substrate. Furthermore, the trailing scraper can be curved in the running direction, which facilitates its resilient compliance and further reduces the friction with the substrate.

Additionally or alternatively, the at least one resilient diaphragm element may also comprise a brush, however, which is preferably arranged at the end on the inlet side of the suction device. Brushes load the substrate still less than a trailing scraper formed from a resilient foil. Therefore, in particular in the case of direct application, the use of brushes is preferred, since the material web and in particular its surface requires particular protection.

The effectiveness of the brush can be influenced via the hardness of its bristles and their extent in the running direction. In the case of application in a free draw of the material web, that is to say a section in which the material web is not supported by a backing element, for example a backing roll, pairs of brushes can be used to ensure the functional capability, the brushes of each pair of brushes being arranged on opposite sides of the material web. Furthermore, the brushes may comprise bristles of different hardness, the bristle hardness preferably decreasing in the running direction of the substrate. In this case, the hard bristles in the feed area retard the air boundary layer, while the following softer bristles gradually convert the laminar flow of the air boundary layer running in into a turbulent flow, which may be removed more easily from the substrate. The softer bristles can preferably be fabricated from natural hair, for example horse hair.

Additionally or alternatively to the trailing scraper and/or the brush, the at least one resilient element can further comprise an element fabricated from foam, preferably foam rubber, which, for example, is arranged on a lateral edge of the suction device. Foam elements of this type can easily adapt their form to the harder parts surrounding them. They are therefore particularly suitable to complete the sealing of the suction device in cooperation with other elements, such as trailing scrapers or brushes.

In the event of a break in the material web and, in the worst case, the subsequent winding of the material web on the backing roll, all the types of resiliently deformable elements mentioned above are readily able to give way to the effective diameter of the backing roll, which increases as a result, and, after the proper operating state has been reproduced, can assume their original position or form again. Therefore, in the event of a break in the material web, they are therefore subjected to no risk of damage or a risk which is only tolerably low.

In order firstly to be able to prevent the reformation or an air boundary layer on the web section between the suction device and the applicator unit, but, secondly, in the case where a curtain applicator unit is used, to be able to prevent physical disruption of the application medium curtain by the suction device or a part arranged on the latter, it is proposed that the distance between the downstream end of the suction device or resilient element, for example the trailing scraper, arranged at the downstream end of the suction device, and the position at which the application medium strikes the substrate have a value of between about 1 mm and about 100 mm, preferably of between about 10 mm and about 50 mm.

According to a further point of view, the object according to the invention is achieved by an application device or the generic type in which the attenuation device comprises an electrode arrangement. This electrode arrangement can influence the air boundary layer in different ways and therefore convert at least part of the laminar flow of the air boundary layer into a turbulent flow.

If the electrode arrangement comprises a plurality of individual electrodes, preferably needle electrodes, arranged adjacent to one another in the transverse direction of the substrate, or if the electrode arrangement comprises at least one flat electrode which, on its side facing the substrate, has a plurality of projections or needle points, then discharges can occur between the electrode and the substrate. The air molecules charged in these discharges are accelerated in the electric field produced by the electrode arrangement and, as a result, can lead to at least partial destruction of the laminar character of the flow of the air boundary layer.

In order to increase the efficiency of this effect, the electrode arrangement can have a distance of between about 2 mm and about 30 mm from the substrate. Furthermore, the electrode arrangement can be kept at a predetermined electric potential which, for example, have a value of between about 5 kV and about 60 kV, preferably about 30 kV.

As an alternative to the discharge effect described above, however, it is also possible for the electrode arrangement to emit a high-frequency alternating electric field. The frequency of the alternative field can be selected such that at least some of the air molecules are excited into oscillation. As a result of these oscillations, again at least part of the laminar flow of the air boundary layer is converted into a turbulent flow.

The further electrode arrangement can, for example, be arranged on the suction device, preferably the downstream end thereof, and electrically insulated from the latter. It is particularly advantageous if the electrode arrangement is arranged in the active suction area of the suction device, that is, to say, for example, in the area of the suction device that is delimited by the at least one resilient element. This is because, in this case, the suction device and the electrode arrangement do not act independently of each other but supplement each other in influencing the air boundary layer. Thus, for example, the turbulent proportion of the flow of the air boundary layer which is produced by the electrode arrangement can be extracted immediately by the suction device.

As an alternative to exciting oscillations via an alternating electric field, comparable excitation of oscillations can also be achieved by means of an attenuation device which comprises an ultrasound source. The frequency of this ultrasound source can again be selected in such a way that at least part of the air molecules are excited into oscillation.

According to a further point of view, the object according to the invention is achieved by an application device of the generic type in which the attenuation device comprises a resilient sealing plate which is mounted at one end and, with its opposite, free end, lies opposite the substrate, the sealing plate being supported at a location between its end on the bearing side and its free end, forming an axis of rotation, so that deflection of the section of the sealing plate between the end on the bearing side and the supporting location because of a differential pressure prevailing between the two sides of the plate at least counteracts deflection of the section of the sealing plate between the supporting location and the free end, in order to maintain a maximum distance, which can in particular be predefined, between the sealing plate and the substrate, in particular even at relatively high differential pressures. An attenuation or sealing device of this type is disclosed, for example, by DE 198 17 202 A1 from the applicant. Reference is therefore hereby made to the complete disclosure content of DE 198 17 202 A1 relating to the construction and the function of this attenuation or sealing device, and made part of the disclosure of this application.

With the aid of this embodiment, functional impairment can substantially be ruled out, even at relatively high running speeds of the substrate. Firstly, disruptive elements carried along by the substrate can pass by the attenuation device without there being an associated risk of damage to the sealing plate, and without the sealing action being permanently lost as a result. Supporting the relatively resilient sealing plate prevents the distance between the sealing plate and the substrate being enlarged at relatively high differential pressures, such as could occur, for example, in the area of a ventilation device that produces a negative pressure. In this way, respective deflection of the section of the sealing plate between the end on the bearing side and the supporting location acts on the section of the sealing plate between the supporting location and the free end in such a way that undesired deflection of the latter is virtually compensated for.

Irrespective of the actual type or construction of the attenuation device, it is advantageous if a conditioning device, which substantially completely removes the uppermost layers of the air boundary layer, is arranged upstream of the attenuation device. The efficiency of the attenuation device normally depends on various influences, for example the running speed of the substrate. As a result of removing the uppermost areas of the air boundary layer, the conditioning device ensures that the dependence on these influences is reduced if not even completely removed. In addition, the attenuation device no longer needs to proceed against the entire air boundary layer but only against the part let through by the conditioning device. In this way, the load on the attenuation device is relieved, and it can be constructed with a correspondingly lower power.

In one simple embodiment, the conditioning device can comprise a bar extending in the transverse direction of the substrate and, for example, can be formed by a simple sheet metal strip. However, it is also possible for the conditioning device to utilize aerodynamic effects, for example by having a cross section, as viewed in the transverse direction, which has the shape or an aerofoil profile standing on its head.

Good results can be achieved, for example, when the conditioning device is arranged at a distance of between about 3 mm and about 10 mm from the substrate.

The conditioning device can be designed to be self-supporting or else fitted to the attenuation device.

As already mentioned above, the attenuation devices according to the invention can be used in particular in an application device which has a curtain applicator unit, that is to say an applicator unit which discharges the application medium onto the substrate as a curtain or veil that moves substantially under the force of gravity.

BRIEF DESCRIPTION OF THE DRAWINGS

The above-mentioned and other features and advantages of this invention, and the maimer of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

Figure 1:
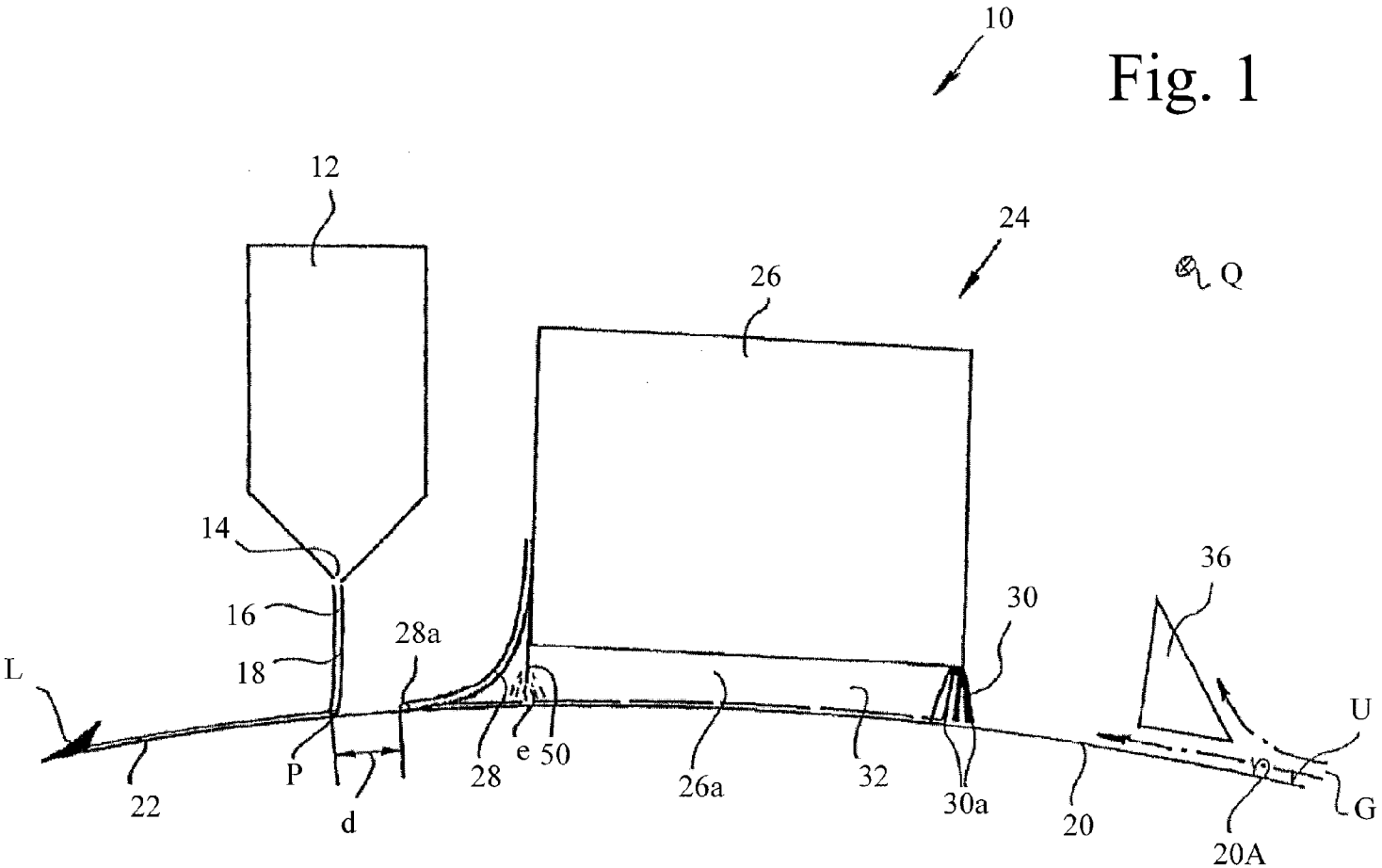
FIG. 1 is a schematical side view of an embodiment of an application device of the present invention.

An application device according to the invention is designated generally by 10 in FIG. 1. It comprises a curtain applicator unit 12, from whose discharge nozzle 14 application medium 16 is discharged as an application medium curtain 18 onto a substrate U moving in the running direction L. In the exemplary embodiment illustrated, the substrate U is formed by the surface 20*a* of a material web 20, to which the application medium 16 is applied as an application layer 22.

In order to attenuate an air boundary layer G, a suction device 24 with a suction box 26 is provided upstream of the applicator unit 12 in the running direction L, being arranged at a predetermined distance from the substrate U. In order to be able to ensure effective extraction in spite of this distance, the suction area 26*a* of the suction box 26 in the exemplary embodiment illustrated is sealed off from the surroundings by means of a plurality of sealing elements 28, 30 and 32 of different design, which are all designed as resiliently deformable elements.

On the outlet side with respect to the running direction L, a resilient foil 28 is fitted to the suction box 26 and can be fabricated, for example, from a composite material which is coated with Teflon on its surface. The foil 28 assumes a course which is curved from top to bottom and from right to left and nestles against the surface 20*a* of the material web 20, being prestressed against the material web 20 on account of its inherent resilience. Furthermore, the foil 28 is pressed against the substrate U by the suction action of the suction box 26, which improves its sealing effect. Upstream of the foil 28, the air boundary layer G that has penetrated into the suction area 26*a* of the suction box 26 backs up, which at least partly destroys the laminar character of the flow of this air boundary layer G and facilitates extraction by the suction box 26 of the air carried along in the air boundary layer G. The downstream end 28*a* of the foil 28 has a distance d from the position P at which the curtain 18 strikes the substrate U. This distance d is dimensioned such that, firstly, the reformation of an air boundary layer on the web section between the suction box 26 and the striking position P, and physical contact between the foil 28 and curtain 18, can be prevented.

On the inlet side, the suction area 26*a* of the suction box 26 is bounded by the brush 30. This brush 30 retards the air boundary layer G entering the suction area 26*a* and attenuates its laminar character to the benefit of turbulent flow components. In order to increase the efficiency of the action of the brush 30, the hardness of the bristles 30*a* of this brush 30 can decrease in the running direction L, which is indicated in FIG. 1 by a thickness of the lines representing the individual brushes 30*a* of the brush 30 that decreases from right to left. Hard bristles are suitable in particular for retarding the air boundary layer G, since they cannot be so easily deflected by the latter, while soft bristles, because of their high mobility, are rather more suitable for converting the laminar flow into a turbulent flow.

Finally, by means of relatively long lines, lateral bounding elements 32 extending substantially orthogonally with respect to the transverse direction Q are also indicated, it being possible for said elements to be fabricated from foam rubber, for example, and to be used to seal off the suction area 26*a* completely relative to the surroundings.

Finally, a conditioning device in the form of a triangular wedge bar is also arranged upstream of the suction device 24 in FIG. 1. This conditioning bar 36 has the task of lifting off the undermost layers of the air boundary layer G before the regions of the air boundary layer close to the substrate are fed to the suction box 26. As a result of this relatively simply provided attenuation of the air boundary layer G, the suction device 24 can be provided with a lower power and therefore more cost-effectively. Furthermore, the thickness of the air boundary layer G following the conditioning bar 36 no longer varies so sharply as a function of the operating parameters of the application device 10 than is the case without the conditioning bar 36.

A further embodiment of an application device according to the invention is illustrated in FIG. 1. This is designated generally by 110 in FIG. 2. In this case, a deflection bar 140 is provided upstream of the curtain applicator unit 112 in the running direction L, one end 140*a* of said deflection bar 140 tapping off part of the air boundary layer G from the substrate U. Furthermore, the deflection bar 140 is designed to be curved in such a way that it deflects a part G' of the air stream tapped off through substantially 180° and causes it to act on the air boundary layer G counter to the running direction L. By this means, the laminar character, at least of the upper regions of the air boundary layer G, can be attenuated. A dividing wall 142 ensures that the air stream G' can be led substantially undisturbed against the air boundary layer G. The deflection bar 140 and the dividing wall 142 preferably have a distance of less than 1 mm from the substrate U.

A further proportion G" of the air tapped off by the deflection bar 140 is led through an opening 140*b* in the deflection bar 140 into a [lacuna] immediately upstream of the application medium curtain 118. The positive pressure produced on the feed side of the curtain 118 in this way helps to stabilize the latter further with respect to the influence of the air boundary layer G.

Figure 3:
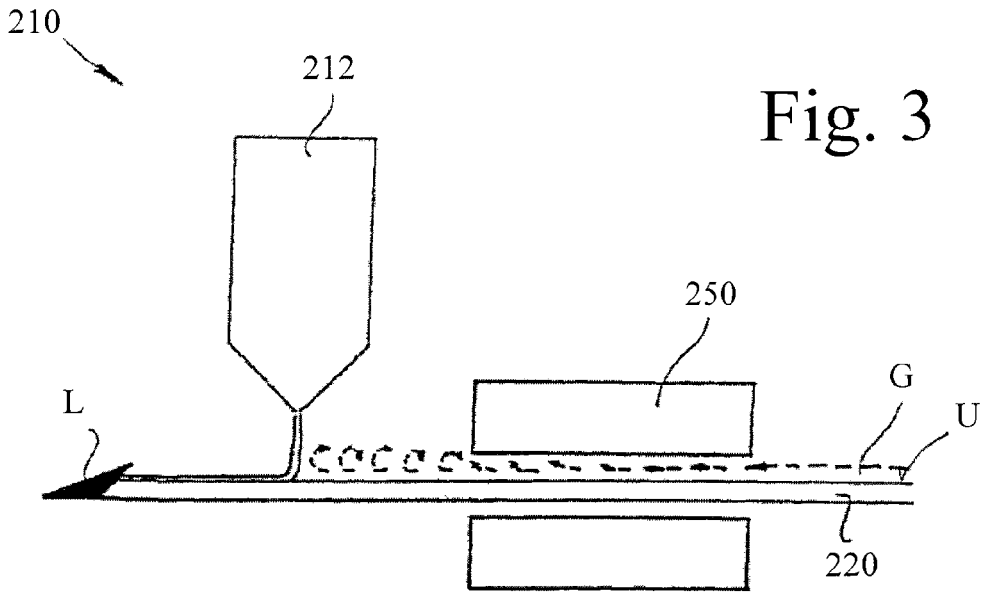
FIG. 3 is a schematical side view of yet another embodiment of an application device of the present invention.

In the case of the application device 210 according to FIG. 3, a device 250 is provided upstream of the curtain applicator unit 212 in the running direction L, which device produces an electric field through which the material web 220 is moved. In this case, the electric field can both lead to electric discharges, which charge the air molecules of the air boundary layer G electrically and accelerate them orthogonally to the substrate U. However, it is also possible for the device 250 to act on the air boundary layer G with a high-frequency alternating electric field whose frequency is chosen in such a way that at least some of the air molecules are excited into oscillation. Both effects lead to at least part of the laminar flow of the air boundary layer G being converted into a turbulent flow, which is indicated in FIG. 3 by swirling arrows which are increasingly curved from right to left and leads to attenuation of the air boundary layer G.

An electrode arrangement 50 corresponding to the field generation device 250 can also be provided in the embodiment according to FIG. 1, to be specific preferably at the downstream end of the suction box 26, between the suction box 26 and the foil 28. The discharge processes e originating from this electrode arrangement 50 disrupt the laminar character of the air boundary layer G, so that the air carried along by the latter can be extracted more easily by the suction box.

Figure 4:
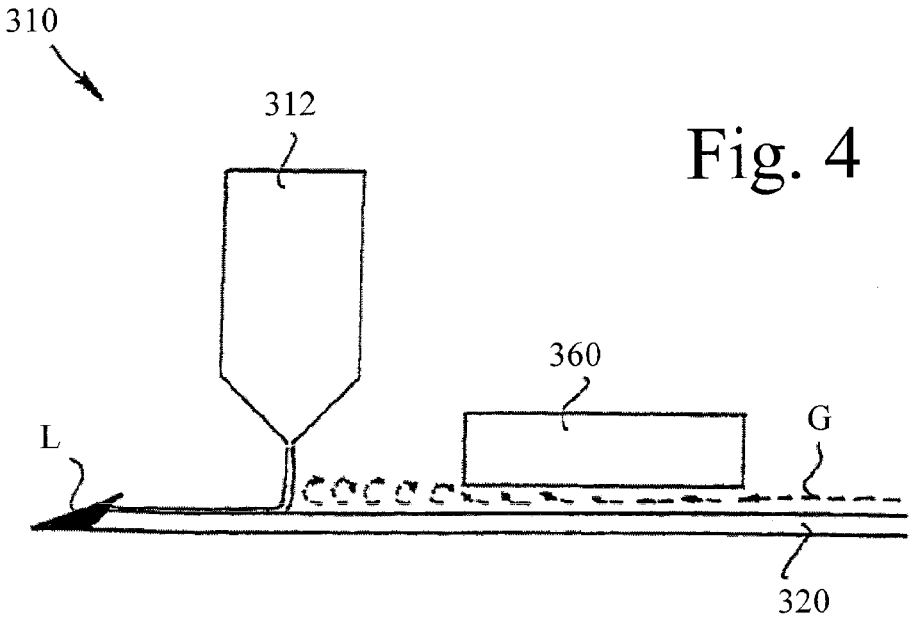
FIG. 4 is a schematical side view of still yet another embodiment of an application device of the present invention.

The application device 310 according to FIG. 4 differs from the embodiment according to FIG. 3 only in the fact that the device 360 provided upstream of the curtain applicator unit 312 in the running direction L to attenuate the air boundary layer G carried along by the material web 320 comprises an ultrasound source whose frequency is selected in such a way that at least some of the air molecules in the air boundary layer G are excited into oscillation. With regard to the attenuation of the air boundary layer G which results from this, reference should be made to the explanations relating to FIG. 3.

Figure 5:
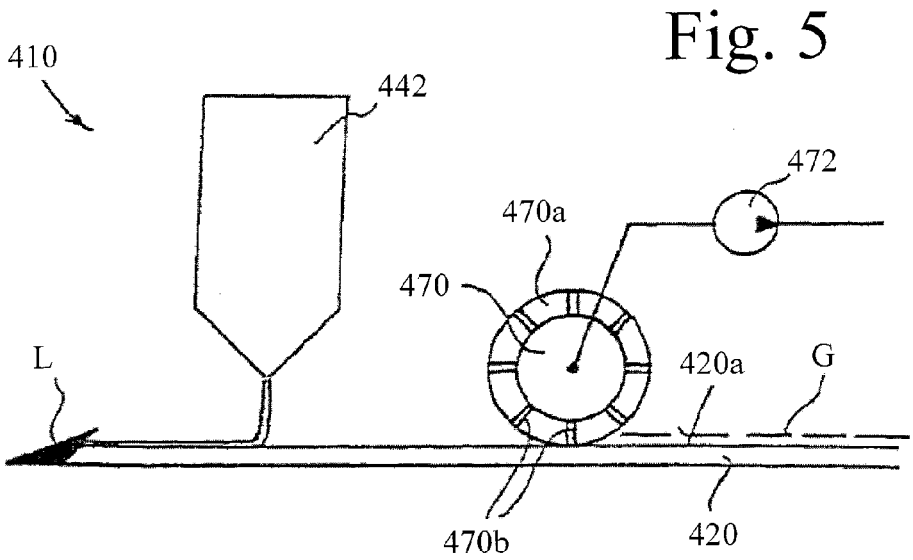
FIG. 5 is a schematical side view of still yet another embodiment of an application device of the present invention.

Finally, as is illustrated in FIG. 5 for the application device 410, the air boundary layer G can also be attenuated by a sealing roll 470 which is arranged upstream of the curtain applicator unit 412 in the running direction L, which is pressed against the surface 420*a* of the material web 420 and rolls on the latter. The cover 470*a* of the sealing roll 470 is fabricated from a resilient material, for example rubber or a rubber-like material, in order to keep the stressing of the material web 420 as a result of the pressure from the roll 470 as low as possible. Furthermore, the roll cover 470*a* has a plurality of apertures 470*b*, and the roll 470 is connected to a suction pump 472, which at least partly extracts the air carried along by the air boundary layer G from the surface 420*a* of the material web 420 through the apertures 470*b*.

Figure 6:
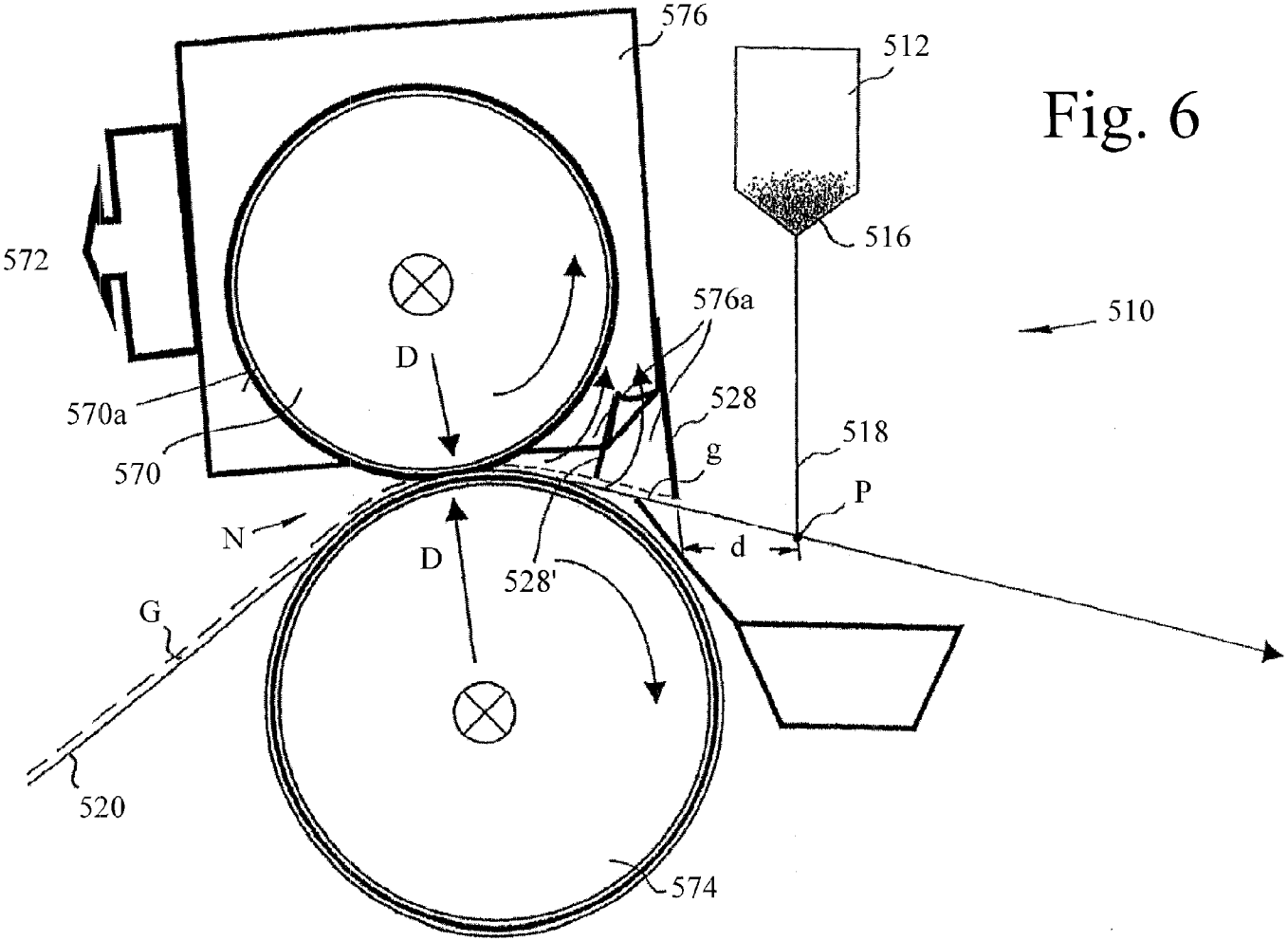
FIG. 6 is a schematical side view of still yet another embodiment of an application device of the present invention.

Alternatively, as is illustrated using the example of the application device 510 in FIG. 6, the sealing roll 570 can also have a roll cover 570*a* that is free of apertures, however. This sealing roll 570, together with a backing roll 574, forms a nip N through which the material web 520 is led. Since the material web 520 wraps around the backing roll 574 in the area of the nip N, and the sealing roll 570 is also set against the material web 520 in the area of the nip N, the air boundary layer G in the nip N is blocked by the sealing roll 570.

Should calendering of the material web 520 be desirable for the purpose of influencing its thickness and/or smoothness and/or porosity profile before the application of medium, then the rolls 570 and 574 can be used simultaneously as calender rolls that can be heated or cooled. For this purpose, setting a specific line pressure or a specific surface pressure in the nip N is required, which is indicated in FIG. 6 by the arrows D.

In order to be able to attenuate further even those components g of the air boundary layer G which could pass through the nip N, in spite of the sealing roll 570, immediately after the sealing roll 570 there is arranged the suction opening 576*a* of a suction box 576, which is connected to a suction pump 572. On the outlet side, the suction opening 576*a* sealed off by means of a diaphragm element 528, for example a trailing scraper set against the material web 520. The suction as shown in FIG. 6, according to which the suction opening 576*a* is divided into two by means of a further diaphragm element 528'.

In order to keep the running section between the suction opening 576*a* and the striking position P of the application medium 516 emerging as a curtain 518 from the applicator unit 512 as short as possible, the sealing roll 570 is accommodated substantially completely in the suction box 576. That is to say, only the circumferential section of the sealing roll 570 that engages with the material web 520, and also circumferential sections which adjoin said section and provide a safety margin between the material web 520 and the suction box 576, project out of the suction box 576.

Figure 7:
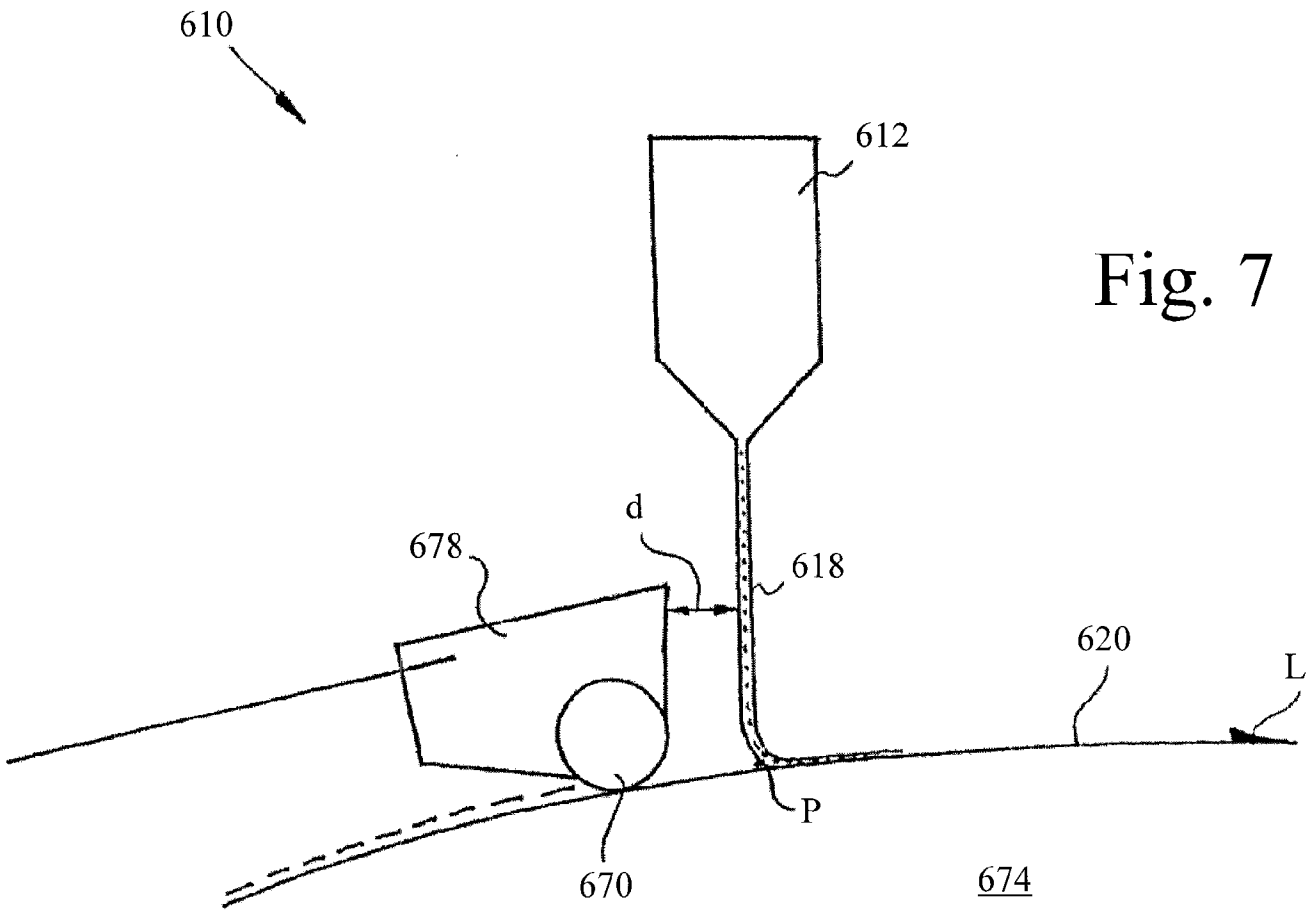
FIG. 7 is a schematical side view of still yet another embodiment of an application device of the present invention.

Although the sealing rolls 470 and 570 according to FIGS. 5 and 6 are in each case designed in combination with a suction device, it is in principle also possible to provide the sealing roll on its own. For this purpose, reference should be made by way of example to the embodiment according to FIG. 7, according to which a sealing roll 670 of a doctor bar type, that is to say a sealing roll with a diameter of between about 10 mm and about 38 mm, which is mounted in a "doctor bed" 678, is set against the material web 620 led around a backing roll 674. This embodiment of the application device 610 makes it possible to keep the length d of the running section between the sealing roll 670 and the striking position P of the application medium curtain 618 emerging from the applicator unit 612 particularly short.

In contrast to the doctor bar type roll 670, the rolls 470 and 570 have a diameter of up to 1000 mm, depending on the machine width, for example a diameter of about 500 mm in the case of a machine width of 4 m. The arrangement of the diaphragm element 528 permits a small distance d from the application medium curtain 518 even in the case of a relatively large roll diameter.

Figure 8:
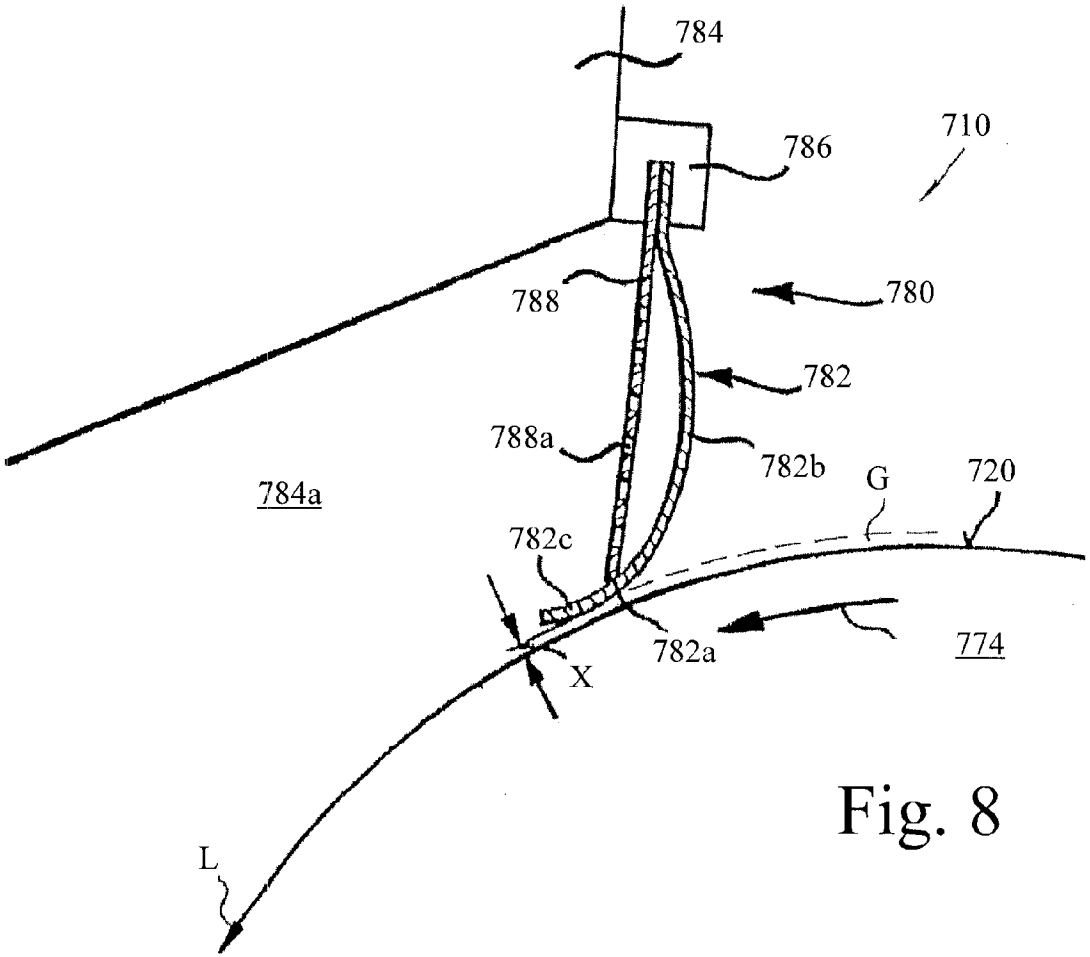
FIG. 8 is a schematical side view of still yet another embodiment of an application device of the present invention.

Finally, FIG. 8 illustrates a sealing device 780 that operates substantially without contact and can be used in an application device 710, to be specific both on its own and also, for example, in combination with other sealing devices, for example instead of the conditioning bar 36 in the embodiment according to FIG. 1. The sealing device 780 comprises a relatively resilient sealing plate 782, which is mounted at one end by means of a bearing 786 provided on a suction box 784 and, with its free end, lies opposite the material web 720, from which it has a distance X.

Apart from its end clamped in the bearing 786, the sealing plate 782 is curved, being curved upward from the negative pressure side 784*a* provided in the area of the suction box 784 toward the positive pressure side. In this case, in the area of its free end, it is led at least substantially tangentially up to the material web 720.

The relatively resilient sealing plate 782 is supported at a location 782*a* between its end on the bearing side and its free end, forming an axis of rotation that extends transversely with respect to the web running direction L, in such a way that deflection of the section 782*b* of the sealing plate between the end on the bearing side and the supporting location 782*a* as a result or a differential pressure prevailing between the two sides of the plate at least counteracts undesired deflection of the section 782*c* of the sealing plate between the supporting location 782*a* and the free end, in order in particular to maintain a maximum distance X between the sealing plate 782 and the material web 720 even at relatively high differential pressures. Therefore, in particular even at relatively high differential pressures, the desired distance X is at least substantially maintained, that is to say in particular does not become larger.

In the present case, the relatively resilient sealing plate 782 is supported by a stiffer supporting place 788 arranged on the negative pressure side 784*a*. Said supporting plate 788 is provided with through openings 788*a* and, at its left-hand end, is clamped into the bearing 786 together with the adjacent end of the sealing plate 782.

The supporting location 782*a*, and therefore the axis of rotation formed in its area, are positioned closer to the free end of the sealing plate 782 than the end on the bearing side of the latter, being arranged in the area of the free end of the sealing plate 782 in the present case. As a result with the left-hand section 782*b* of the sealing plate a relatively large active area is obtained which is exposed to the differential pressure and whose deflection counteracts undesired deflection of the section 782*c* of the sealing plate that is adjacent to the material web 720 in such a way that the result is virtually no change in the distance X, even at higher differential pressures. The openings 788*a* provided in the supporting plate 788 ensure that the section 782*b* of the sealing plate between the end on the bearing side and the supporting location 782*a* is acted on by the negative pressure in the required manner.

As can be seen from FIG. 8, the sealing plate 782, while forming an axis of rotation that extends transversely with respect to the web running direction L, is supported by the free right=hand end of the stiffer supporting plate 788 located underneath.

The distance to be maintained between the section 782*c* of the sealing plate and the material web 720 can be adjustable. In addition, this distance X can even be given with the machine at a standstill or at low web running speeds. In principle, however, dynamic sealing is also possible, in which the section 782*c* of the sealing plate is lifted by part of the air boundary layer G only when the machine is started up, that is to say with increasing web speed, with the desired distance X being established at the latest when operating speed is reached. Because of the non-contact sealing being established at the latest during operation, it is therefore not possible for abrasion to occur even in this case.

The sealing device 780 therefore in every case prevents a major proportion of the air G dragged along by the material web 720 getting into the area of the striking point P of the application medium curtain, not illustrated in FIG. 8.

The air boundary layer G dragged along by the material web 720 is therefore for the major part scraped off or wiped off. One further advantage which may be mentioned is that the section 782*c* of the sealing plate can readily give way to contaminants carried along on the surface of the material web 720, and, even in the event of a web break and "packing" of the supporting roll 774, the risk of damage to the sealing device 730 is reliably prevented.

The invention claimed is:

1. An application device for applying at least one of liquid and pasty application medium to a moving substrate, comprising:

an applicator unit arranged at a distance from the substrate, said applicator unit discharging the application medium onto the substrate, the substrate moving in a direction; and an air boundary attenuation device arranged upstream of said applicator unit, said air boundary attenuation device being a sealing element in sealing contact with the substrate, said sealing element rolling on the substrate, said sealing element being an endlessly circulating sealing belt.

2. An application device for applying at least one of liquid and pasty application medium to a moving substrate, comprising:

an applicator unit arranged at a distance from the substrate, said applicator unit discharging the application medium onto the substrate, the substrate moving in a direction;

an air boundary attenuation device arranged upstream of said applicator unit, said air boundary attenuation device being a sealing element in sealing contact with the substrate, said sealing element rolling on the substrate;

a suction device having a suction opening arranged between said sealing element and said applicator unit; and a diaphragm element, said suction opening being bounded on at least one of an outlet side and a feed side by said diaphragm element.

3. The application device of claim 2, wherein said diaphragm element is resiliently deformable and is set against the surface of the substrate as a trailing scraper.

4. The application device of claim 2, wherein said applicator unit is a curtain applicator unit, which discharges the application medium onto the substrate as a curtain that moves substantially under the force of gravity.

5. An application device for applying at least one of liquid and pasty application medium to a moving substrate, comprising:

an applicator unit arranged at a distance from the substrate, said applicator unit discharging the application medium onto the substrate, the substrate moving in a direction; and an air boundary attenuation device arranged upstream of said applicator unit, said air boundary attenuation device being a sealing element in sealing contact with the substrate, said sealing element wiling on the substrate; said air boundary attenuation device being an electrode arrangement.

6. The application device of claim 5, wherein said electrode arrangement includes a plurality of individual electrodes arranged adjacent to one another in a direction substantially transverse to the substrate.

7. The application device of claim 6, wherein said plurality of individual electrodes are a plurality of needle electrodes.

8. The application device of claim 7, wherein said electrode arrangement includes at least one flat electrode having one of a plurality of projections and a plurality of needle points facing the substrate.

9. The application device of claim 8, wherein said electrode arrangement is positioned between approximately 2 mm and 30 mm from the substrate.

10. The application device of claim 5, wherein said electrode arrangement is kept at a predetermined electric potential.

11. The application device of claim 10, wherein said predetermined electric potential is between approximately 5 kV and 60 kV.

12. The application device of claim 5, wherein said electrode arrangement emits a high-frequency alternating electric field.

13. The application device of claim 12, wherein said high-frequency alternating electric field excites some air molecules into oscillation.

14. The application device of claim 5, further comprising a suction device, said electrode arrangement arranged on said suction device, said electrode arrangement being electrically insulated from said suction device.

15. An application device for applying at least one of liquid and pasty application medium to a moving substrate, comprising:

an applicator unit arranged at a distance from the substrate, said applicator unit discharging the application medium onto the substrate, the substrate moving in a direction; and an air boundary attenuation device arranged upstream of said applicator unit, said air boundary attenuation device being a sealing element in sealing contact with the substrate, said scaling element rolling on the substrate; said air boundary attenuation device being an ultrasound source having a frequency associated therewith.

16. The application device of claim 15, wherein said frequency causes at least some air molecules to be excited into oscillation.

17. An application device for applying at least one of liquid and pasty application medium to a moving substrate, comprising:

an applicator unit arranged at a distance from the substrate, said applicator unit discharging the application medium onto the substrate, the substrate moving in a direction;

an air boundary attenuation device arranged upstream of said applicator unit, said air boundary attenuation device being a sealing element in scaling contact with the substrate, said sealing element rolling on the substrate; and a conditioning device, which substantially removes an uppermost layer of an air boundary layer, said conditioning device ranged upstream of said air boundary attenuation device.

18. The application device of claim 17, wherein said conditioning device includes a bar extending in a transverse direction relative to the substrate.

19. The application device of claim 17, wherein said conditioning device has a cross sectional profile in the shape of an aerofoil.

20. The application device of claim 17, wherein said conditioning device is positioned at a distance of between approximately 3 mm and 10 mm from the substrate.

21. The application device of claim 17, wherein said conditioning device is self-supporting.

22. The application device of claim 17, wherein said conditioning device is fitted to said attenuating device.

23. An application device for applying at least one of liquid and pasty application medium to a moving substrate, comprising:

an applicator unit arranged at a distance from the substrate, said applicator unit discharging the application medium onto the substrate, the substrate moving in a direction; and an air boundary attenuation device arranged upstream of said applicator unit, said air boundary attenuation device being a resilient sealing plate being mounted at one end thereof, said sealing plate having an opposite free end located proximate the substrate, said sealing plate being supported at a supporting location between said end and said free end, forming an axis of rotation, such that deflection of a section of said sealing plate between said end and said supporting location because of a differential pressure prevailing between two sides of said sealing plate, said differential pressure keeping said sealing plate at a predetermined distance from the substrate.

* * * * *

UNITED STATES PATENT AND TRADEMARK OFFICE

CERTIFICATE OF CORRECTION

PATENT NO. : 7,192,485 B2
APPLICATION NO. : 10/865201
DATED : March 20, 2007
INVENTOR(S) : Richard et al.

It is certified that error appears in the above-identified patent and that said Letters Patent is hereby corrected as shown below:

COLUMN 2

At lines 64 through 65, after “relatively”, delete “strikes the substrate, because of their” and substitute therefore --small diameter. In principle, however,--.

COLUMN 4

At line 37, after “reformation” please delete “or”, and substitute therefore --of--.

COLUMN 5

At line 5, please delete “have”, and substitute therefore --has--.

COLUMN 6

At line 27, after “shape” please delete “or” and substitute therefore --of--; and At line 44, please delete “maimer”, and substitute therefore --manner--.

COLUMN 7

At line 62, please delete “high”, and substitute therefore --higher--.

COLUMN 8

Figure 2:
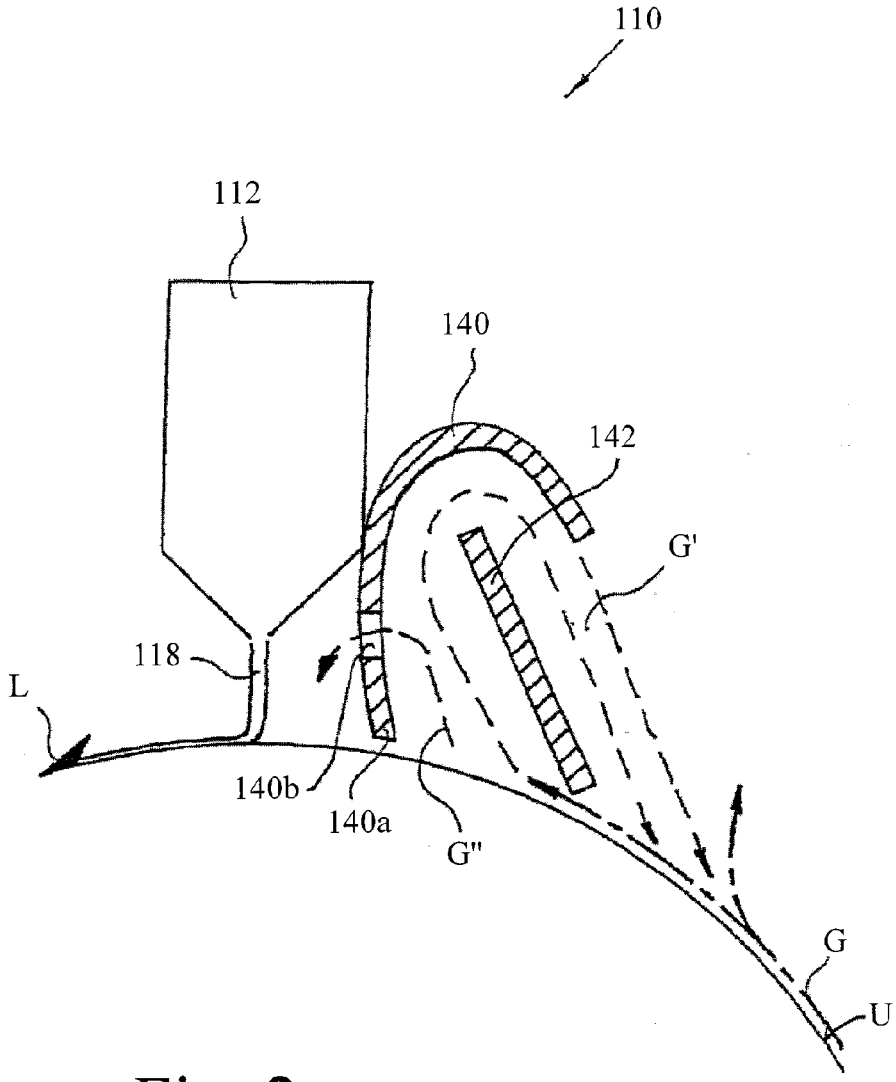
FIG. 2 is a schematical side view of another embodiment of an application device of the present invention.

At line 17, please delete “FIG. 1”, and substitute therefore --FIG. 2--.

COLUMN 9

At line 47, between “576a” and “sealed”, insert --is--; and

At line 49, between “suction” and “as”, insert --opening 576a can follow the sealing roll 570 directly,--.

COLUMN 11

At line 7, please delete “right=hand”, and substitute therefore --right-hand--; and At line 32, please delete “730”, and substitute therefore --780--.

UNITED STATES PATENT AND TRADEMARK OFFICE

CERTIFICATE OF CORRECTION

PATENT NO. : 7,192,485 B2
APPLICATION NO. : 10/865201
DATED : March 20, 2007
INVENTOR(S) : Richard et al.

It is certified that error appears in the above-identified patent and that said Letters Patent is hereby corrected as shown below:

COLUMN 12

At line 15, please delete “wiling”, and substitute therefore --rolling--.

Signed and Sealed this

Twentieth Day of November, 2007

JON W. DUDAS
*Director of the United States Patent and Trademark Office*